US008074557B2

(12) United States Patent
Kurz

(10) Patent No.: US 8,074,557 B2
(45) Date of Patent: Dec. 13, 2011

(54) ELECTROHYDRAULIC BOOSTER

(75) Inventor: Manfred Kurz, Altenstadt (DE)

(73) Assignee: Hoerbiger Automatisierungstechnik Holding GmbH, Schongau (DE)

( * ) Notice: Subject to any disclaimer, the term of this patent is extended or adjusted under 35 U.S.C. 154(b) by 62 days.

(21) Appl. No.: 12/779,188

(22) Filed: May 13, 2010

(65) Prior Publication Data

US 2010/0224059 A1 Sep. 9, 2010

Related U.S. Application Data

(63) Continuation of application No. PCT/EP2008/009467, filed on Nov. 10, 2008.

(51) Int. Cl.
*F15B 9/10* (2006.01)
*F15B 13/04* (2006.01)
*F15B 15/17* (2006.01)

(52) U.S. Cl. ..... 91/378; 91/49; 91/417 R

(58) Field of Classification Search ..... 91/49, 378, 91/415, 417 R, 422
See application file for complete search history.

(56) References Cited

U.S. PATENT DOCUMENTS 1,822,667 A * 9/1931 Proell ..... 91/378
3,390,612 A * 7/1968 Wills ..... 91/417 R
3,678,803 A * 7/1972 Schwenzfeier ..... 91/378
4,779,837 A 10/1988 Mito et al.
4,907,492 A 3/1990 Hampejs
4,934,250 A * 6/1990 Siegel ..... 91/378

FOREIGN PATENT DOCUMENTS

DE 19757157 7/1999
EP 0296104 12/1988

OTHER PUBLICATIONS

International Search Report for corresponding International Application No. PCT/EP08/009467 mailed Sep. 4, 2009.

* cited by examiner

*Primary Examiner* — Michael Leslie
(74) *Attorney, Agent, or Firm* — Myers Wolin, LLC

(57) ABSTRACT

An electrohydraulic booster comprises an electromechanical transducer and a hydromechanical power stage which is connected to a pressurized medium supply and encompasses a cylinder and a piston that can be moved therein along the working axis. The electromechanical transducer acts on a spool valve which is associated with the hydromechanical power stage, is disposed at least in part inside the piston, is guided within a guiding bore in such a way as to be movable along the working axis, and has two first leading edges that cooperate with corresponding second leading edges located on the guiding bore in order to form a hydraulic sequential control. The guiding bore consists of two parts, i.e. a cylinder-mounted first section and a second section which can be moved along the working axis and comprises the second leading edges.

14 Claims, 7 Drawing Sheets

ELECTROHYDRAULIC BOOSTER

Figure 1:
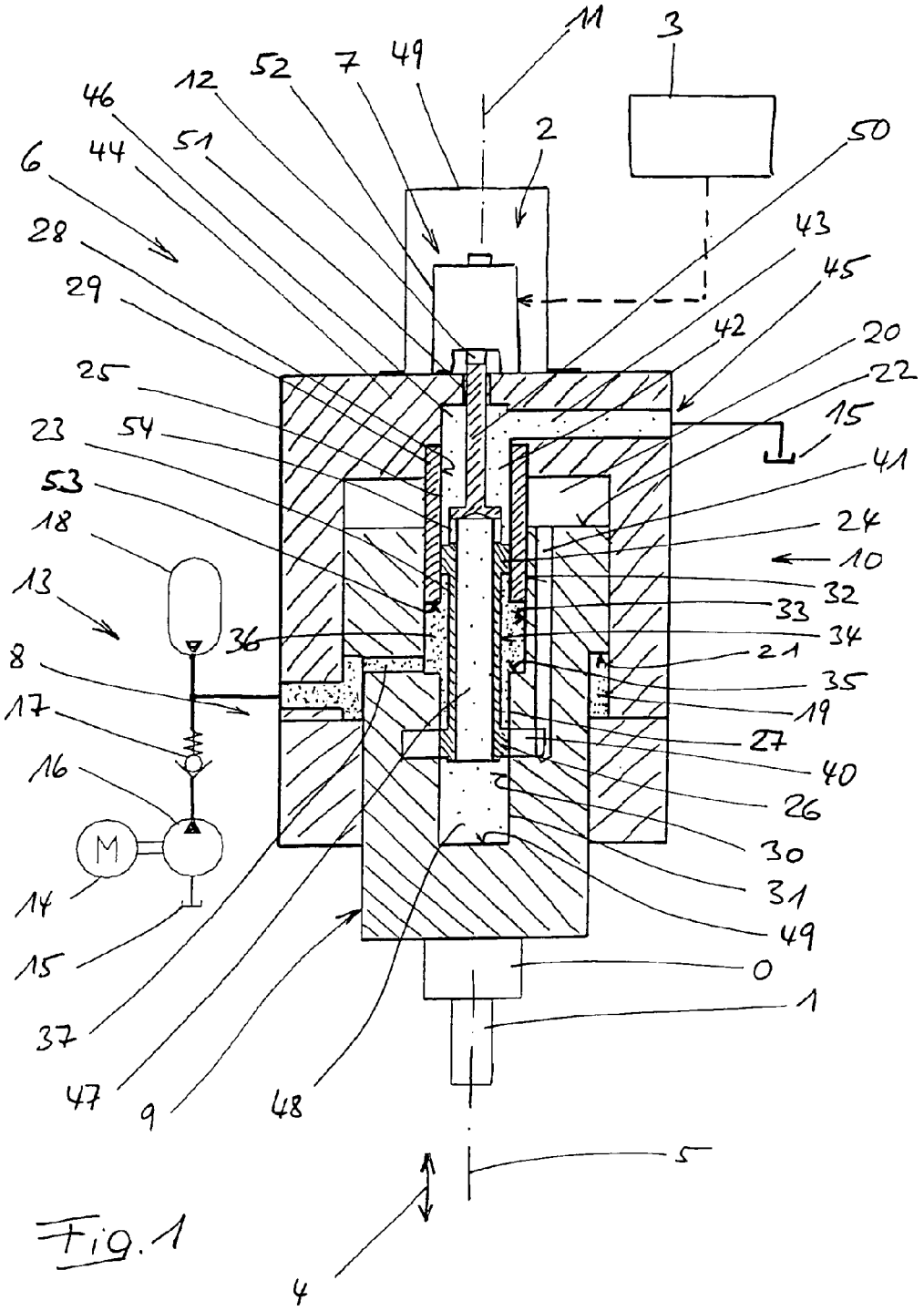

The present application is a continuation under 35 U.S.C. §120 of International Patent Application No. PCT/EP08/009,467 filed on Nov. 10, 2008, and claims priority under 35 U.S.C. §119 to German Patent Application No. 10 2007 054 774.0 filed on Nov. 16, 2007, and to German Patent Application No. 10 2007 054 533.0 filed on Nov. 15, 2007, the disclosures of each of the above applications being expressly incorporated herein by reference in their entireties.

The present invention relates to an electrohydraulic booster having an electromechanical transducer and a hydromechanical power stage, which is connected to a pressurized-fluid supply and is provided with a cylinder and a piston that can be displaced therein along the working axis, wherein the electromechanical transducer acts on a spool valve, which is associated with the hydromechanical power stage, is disposed at least partly in the interior of the piston and is guided displaceably along the working axis in a guide bore, and which is provided with two first leading edges that cooperate with corresponding second leading edges provided on the guide bore to form a hydraulic sequential control.

Electrohydraulic boosters of the type described in the foregoing are known in various constructions. In this regard, examples of the prior art can be found in EP 0296104 A1 and DE 19757157 C2. According to EP 0296104 A1, the hydromechanical power stage is of one-stage construction, wherein the spool valve—actuated by the electromechanical transducer as the input stage—directly controls the admission of hydraulic fluid to the piston. In contrast, in the electrohydraulic booster according to DE 19757157 C2, the hydromechanical power stage is of two-stage construction, wherein the spool valve is constructed as a pilot spool valve, which admits hydraulic fluid into a control chamber to control the displacement of a control sleeve disposed and movable coaxially relative to the spool valve, and the control sleeve in turn—via pairs of third and fourth leading edges cooperating with one another—controls the admission of hydraulic fluid to the piston. Such electrohydraulic boosters can be used, for example, as drives for machines or aggregates of the most diverse type and for various further applications.

The electrohydraulic boosters known from the prior art (still) meet the increasingly more demanding requirements of the users, who place value in particular on the highest power (for example, forces of up to or even greater than 30 metric tons), economy and accuracy (reproducibility) to only a limited extent. The aspect of economy also includes in particular the viewpoint of a high dynamic (meaning working frequencies of up to or even more than 20 working cycles per second), since this is sometimes of decisive importance for manufacturing speed.

To some extent, the requirements indicated in the foregoing have conflicting objectives. For example, the provision of large forces necessitates correspondingly heavy dimensioning of the components of the hydromechanical power stage, thus adversely influencing the achievable dynamic because of the associated large masses of the moving parts.

In contrast to the prior art described in the foregoing, the object of the present invention is accordingly to provide an electrohydraulic booster of the class in question that satisfies the existing technical requirements of the users in special manner, in that it is characterized in particular by the possibility of large forces while at the same time achieving a particularly high dynamic.

The object indicated in the foregoing is achieved according to the invention by the fact that, in an electrohydraulic booster of the type indicated in the introduction, the guide bore is constructed in two parts, with a first portion rigidly joined to the cylinder and a second portion whose position can be varied along the working axis and which is provided with the second leading edges. For the inventive electrohydraulic booster, therefore, it is decisive that—in a departure from the known designs—a two-part guide bore instead of a one-part guide bore is provided for the spool valve, wherein the two portions of the guide bore serving to guide the spool valve can be moved relative to one another along the working axis, by the fact that a first portion is rigidly joined to the cylinder and a second portion, which is provided with the second leading edges, can be displaced in working direction of the piston. In this way, the total length of the guide bore can be substantially reduced compared with a one-part guide bore. At the same time, this permits a decrease of the overall dimensions of the hydromechanical power stage and accordingly a reduction of the moving masses, so that even electrohydraulic boosters designed to achieve high forces can be operated with a dynamic not achievable heretofore in this power group. Furthermore, the inventive construction of the electrohydraulic booster results in not inconsiderable benefits in terms of manufacturing technology, since the two individual portions of the guide bore can be manufactured more easily with the requisite precision than can one continuous long guide bore. Furthermore, the inventive electrohydraulic booster is also favorable as regards reliable operation, since problems that may result from deformations and/or misalignments of the parts relative to one another in known electrohydraulic boosters of the class in question with a continuous long guide bore can be alleviated by use of the present invention. As a result, the invention is capable of providing, for use as the drive in diverse areas of application, an electrohydraulic booster that not only is particularly efficient in the manner described in the foregoing but also can be constructed relatively robustly, simply and reliably and is suitable for implementing definite working or movement programs with the highest precision.

In this regard, it is particularly favorable, according to a first preferred improvement of the invention, for the first portion of the guide bore to be constructed in a guide sleeve inserted in the cylinder or in the cylinder component. This guide sleeve can extend in particular through a space filled with hydraulic fluid, meaning that at least regions of its outer surface are surrounded by flowing hydraulic fluid. Not only does this have advantages in manufacturing technology compared with construction of the corresponding portion of the guide bore directly on the cylinder component, but also this configuration is favorable in terms of reliability, especially if the guide sleeve can be moved—within certain limits—relative to the cylinder component, in order to compensate for operation-related deformations and/or manufacturing-related tolerances.

According to another preferred improvement of the invention, it is provided that the return-flow port of the hydromechanical power stage is disposed in the region of the end wall of the cylinder component, in which case the return flow of the hydromechanical power stage passes through the spool valve. The special advantages of this configuration lie, for example, in a particularly low overall height of the hydromechanical power stage and the possible minimization of the moving masses made possible hereby.

Another preferred improvement of the inventive electrohydraulic booster is characterized in that the electromechanical transducer, or in other words its stator, is mounted directly on the end wall of the cylinder component. The very short load travels possible in this way permit particularly high precision of the electrohydraulic booster. In other words: Because the stator of the electromechanical transducer is mounted directly onto the end wall of the cylinder of the hydromechanical power stage, influences that could adversely affect the precision of the machine are largely avoided. In addition, an electrohydraulic booster improved in this way has particularly compact construction.

In this regard, an electrical linear direct drive whose motor axis is oriented parallel to the working axis, or in other words in z-direction, and whose armature (lineator or linear actor) acts directly on the spool valve, is used particularly preferably as the electromechanical transducer. The feature that is particularly characteristic for this improvement is therefore that there are provided, in a combination cooperating with one another and matched to one another, a hydromechanical power stage, whose piston can be displaced along the working axis inside a cylinder, and an input stage in the form of a genuine electrical linear direct drive, whose armature acts on the spool valve of the hydromechanical power stage guided displaceably in z-direction inside a two-part guide bore. The spool valve is provided with two first leading edges, which cooperate with second leading edges formed on the second portion of the guide bore, in which case, by virtue of the cooperation of the first and second leading edges in the sense of a hydraulic sequential control, any displacement of the spool valve in z-direction ultimately results—directly or indirectly (see below)—in repositioning of the piston of the hydromechanical power stage by an identical travel. The displacement of the spool valve along the z-direction by means of the electrical linear direct drive is therefore converted 1:1 into a corresponding movement, identical in direction and magnitude, of the piston of the hydromechanical power stage. Consequently, such hydromechanical boosters are characterized in particular by relatively simple and robust construction and by high reliability during operation. At the same time, they can be extremely compact and work particularly precisely, especially since they do not necessitate any kind (mechanical or other) of signal feedback pertaining to the position of the piston and potentially having adverse effects not only for the dynamic of the possible movement program but also for its precision. To the contrary, the movement program—which if necessary is resident in a numerical controller acting on the electromechanical transducer—is converted directly, or in other words without signal feedback in the sense of a control loop, into a movement of the spool valve and a 1:1 sequential movement of the piston of the hydromechanical power stage.

Within the meaning of the improvement described in the foregoing, the stator of the electrical linear direct drive can be joined rigidly to an end wall of the cylinder of the hydromechanical power stage. This is especially true if, according to yet another preferred improvement of the invention, the armature of the electrical linear direct drive is joined rigidly to the spool valve via a coupling rod passing through the end wall of the cylinder.

The coupling rod described in the foregoing and joining the armature of the electrical linear direct drive rigidly to the spool valve then preferably extends through a low-pressure space of the cylinder of the hydromechanical power stage, in which space the pressure is substantially the return-flow pressure. In this way, only relatively mild requirements are imposed on the seal between the coupling rod and the cylinder. Accordingly, no noteworthy frictional forces act on the coupling rod in the region of the seal, and this in turn is favorable both with regard to the dynamic of the electrohydraulic booster and with regard to its precision (reproducibility of the piston movement).

In a particularly preferred improvement of the invention in this respect, no seal whatsoever is provided in the region of the penetration of the coupling rod through the end wall of the cylinder. To the contrary, the armature of the electrical linear direct drive is received in this case in a bushing joined sealingly to the cylinder component of the hydromechanical power stage and passing through the stator of the electrical linear direct drive, the interior space of the bushing being in communication with a low-pressure space, containing hydraulic fluid, of the hydromechanical power stage. In this way there is developed an exchange, which may be supported by the oscillating movement of the coupling rod, of hydraulic fluid between the low-pressure space of the hydromechanical power stage and the said bushing surrounding the armature of the electrical linear direct drive, thus allowing effective cooling of the electrical linear direct drive to be achieved by the constantly renewed hydraulic fluid. Such cooling is valuable in particular when the said bushing is received in heat-conducting relationship in the stator of the electrical linear direct drive. By the fact that temperature fluctuations in the electrical linear direct drive can be reduced to a minimum in this way, the reproducibility and thus the precision of the electrohydraulic transducer is in turn. At the same time, it is possible to use relatively compact components, and this is favorable not only with respect to the needed overall room but also with respect to the dynamic of the electrohydraulic booster, because the moving masses can be minimized. A similar effect can be achieved if—instead of receiving (only) the armature of the electrical linear direct drive, in the manner explained in the foregoing, in a bushing filled with hydraulic fluid—the electrical linear direct drive is housed entirely in a housing connected sealingly with the cylinder component of the hydromechanical power stage, the interior space of the housing being in communication with a low-pressure space, containing hydraulic fluid, of the hydromechanical power stage.

Within the scope of the present invention, different configurations of the hydromechanical power stage are entirely conceivable. In particular, the hydromechanical power stage can be of one-stage or else of two-stage construction. In a one-stage construction of the hydromechanical power stage, the second leading edges are disposed rigidly on the piston. In this way, the piston of the hydromechanical power stage directly follows the movement of the spool valve.

On the other hand, if the hydromechanical power stage is of two-stage construction, the spool valve—actuated by the electromechanical transducer—represents a pilot spool valve, and the second leading edges are constructed on a control sleeve guided displaceably along the working axis in the piston, the control sleeve in turn being provided with two third leading edges, which cooperate with two corresponding fourth leading edges of the piston to form a hydraulic sequential control. In this configuration, the piston of the hydromechanical power stage follows the movement of the spool valve only indirectly, by the fact that the control sleeve follows the movement of the spool valve and the piston follows the movement of the control sleeve. In this way, the first and second leading edges, which cooperate with one another, drive only a relatively small flow of hydraulic fluid, namely that volume flow necessary for positioning the control sleeve. In contrast, the volume flow used to position the piston of the hydromechanical power stage is controlled by the third and fourth leading edges, which cooperate with one another.

In a two-stage construction of the hydromechanical power stage there are preferably provided two stops, which limit the movement of the control sleeve relative to the piston in the direction of the working axis to a certain proportion of the maximum working stroke of the piston. Such stops are particularly advantageous inasmuch as they permit (for a given maximum stroke of the piston) a shorter overall length of the hydromechanical power stage compared with an embodiment lacking such stops. As regards this function, it is possible, for example, to limit the total movement range of the control sleeve relative to the piston to a proportion of 5% to 25%, particularly preferably 10% to 15% of the given maximum stroke of the piston, so that, in the case of a designed maximum piston stroke of 40 mm, for example, the control sleeve can be moved from a neutral position, in which the third and fourth leading edges are ideally flush against one another, outward by 2.5 mm (6.25% of the piston stroke) in both directions relative to the piston. If necessary, it is also possible, by means of the said stops, to provide an asymmetric limitation of the movement capability of the control sleeve relative to the piston.

Figure 1A:
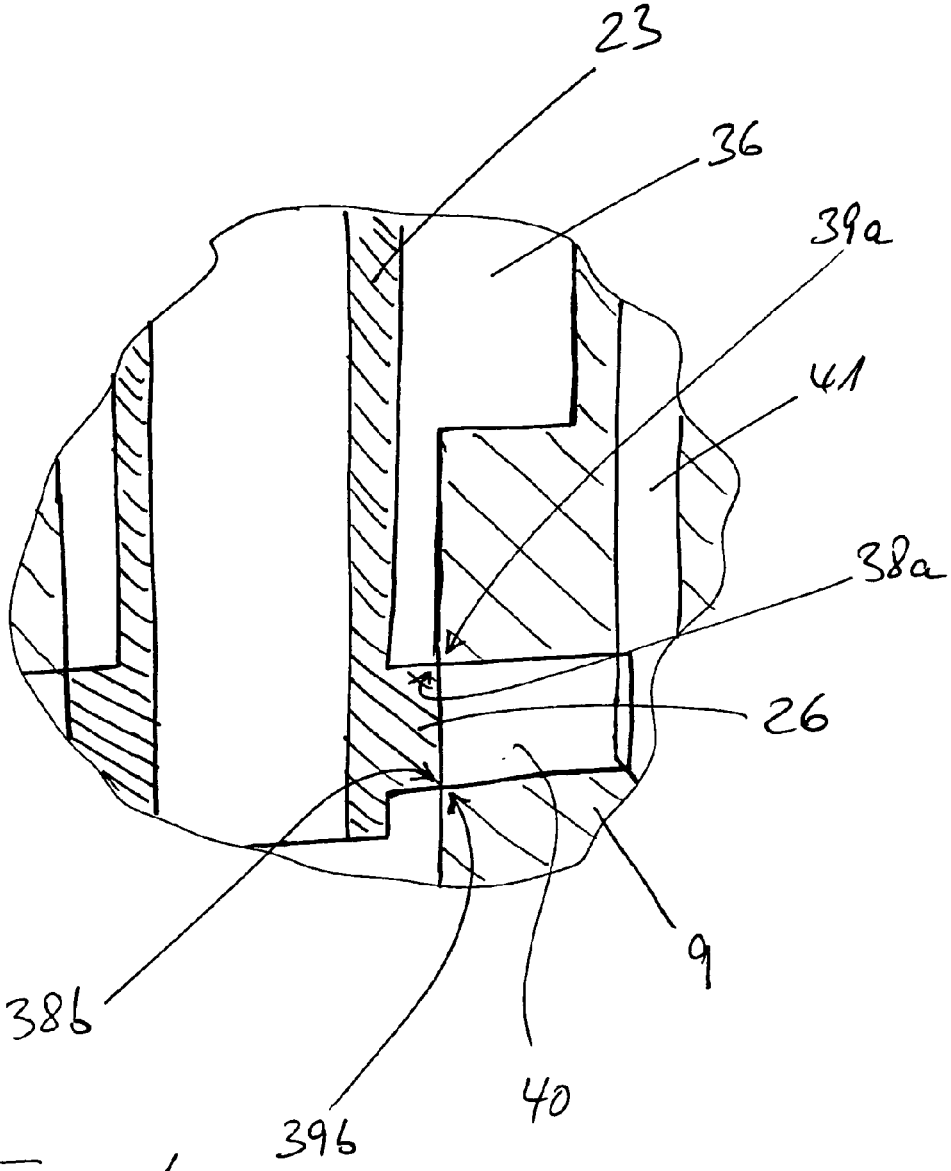
Figure 2:
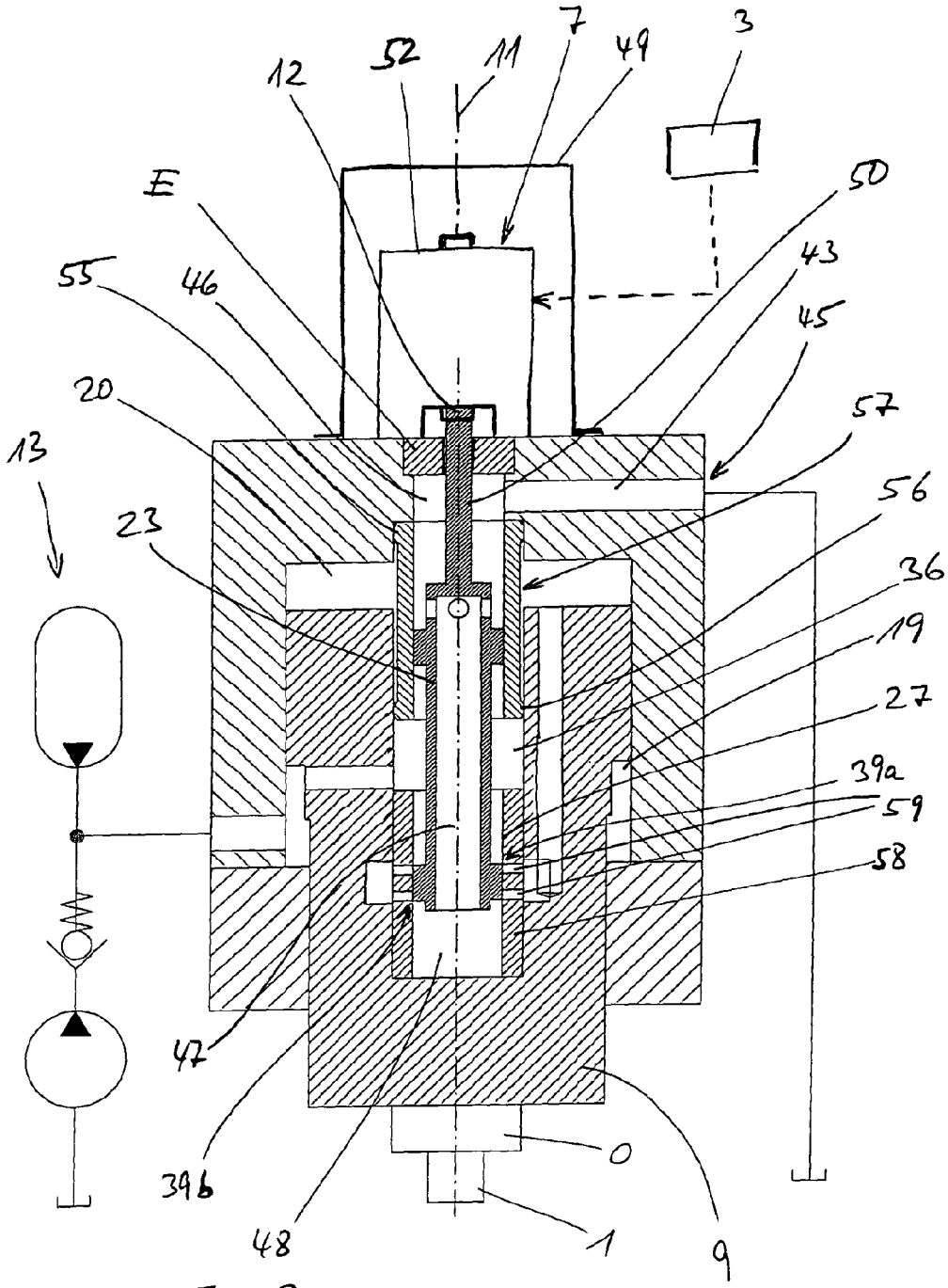
Figure 3:
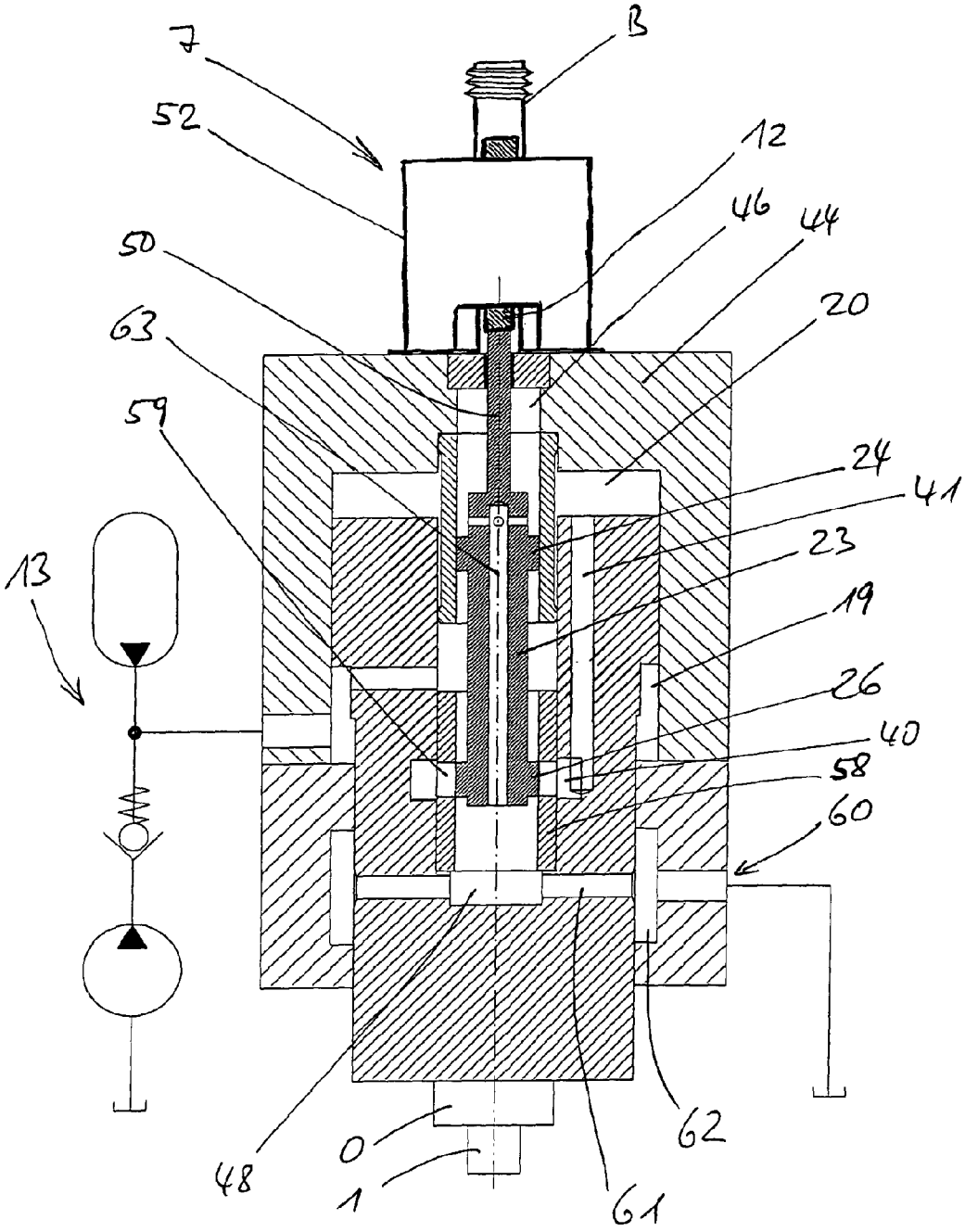
Figure 4:
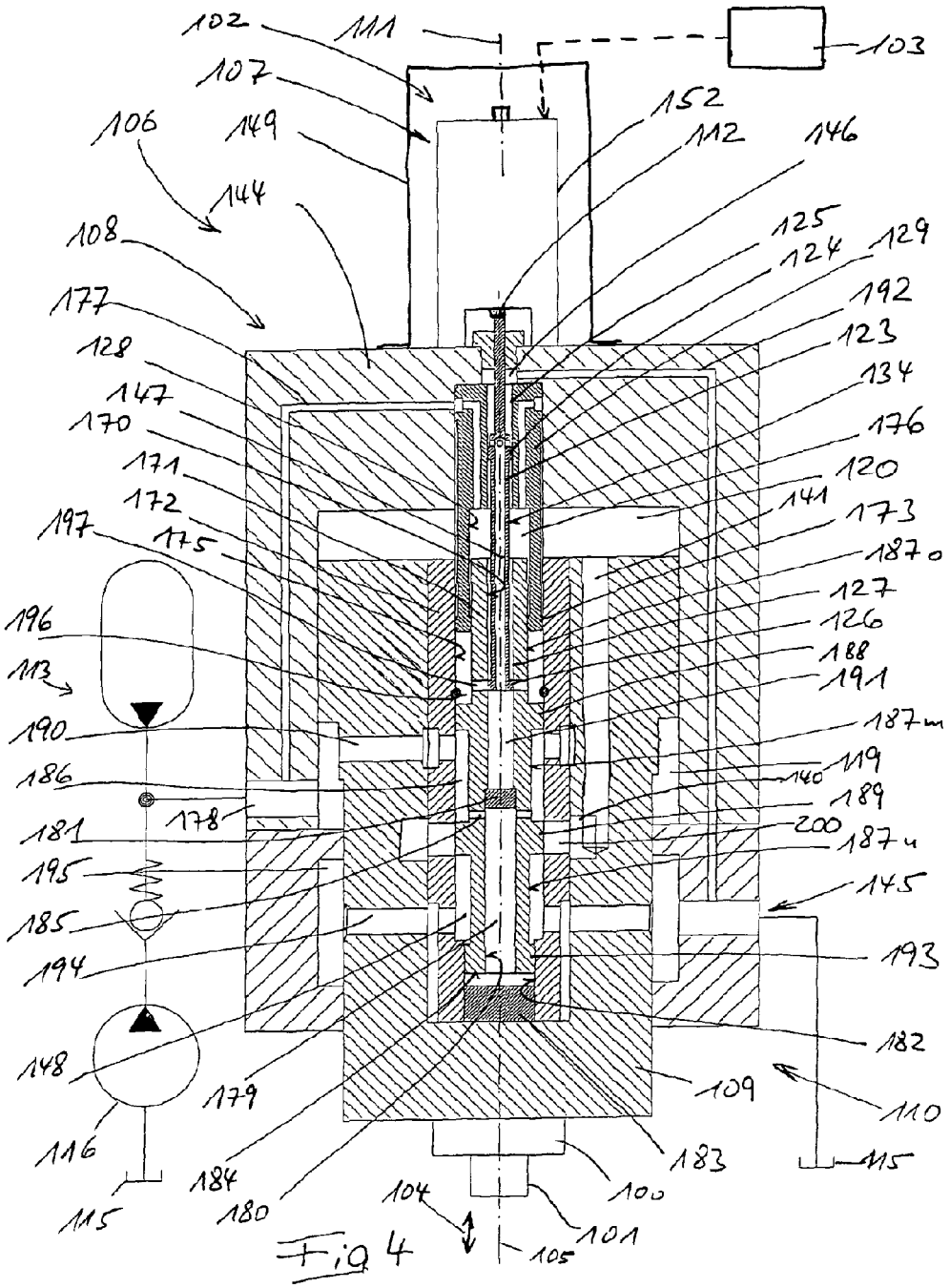
Figure 4A:
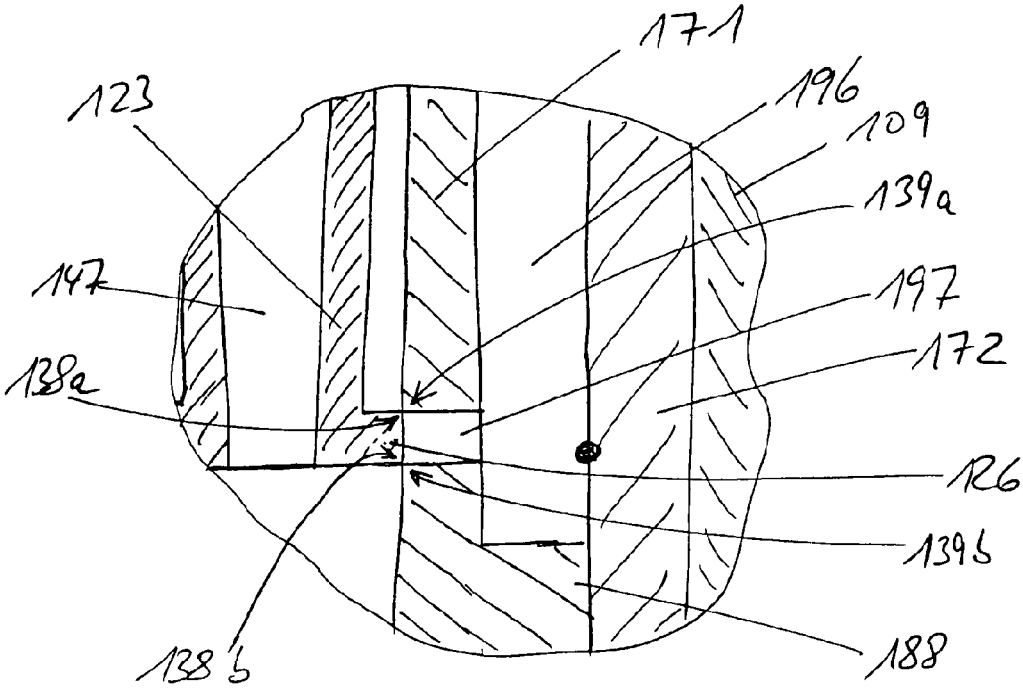
Figure 4B:
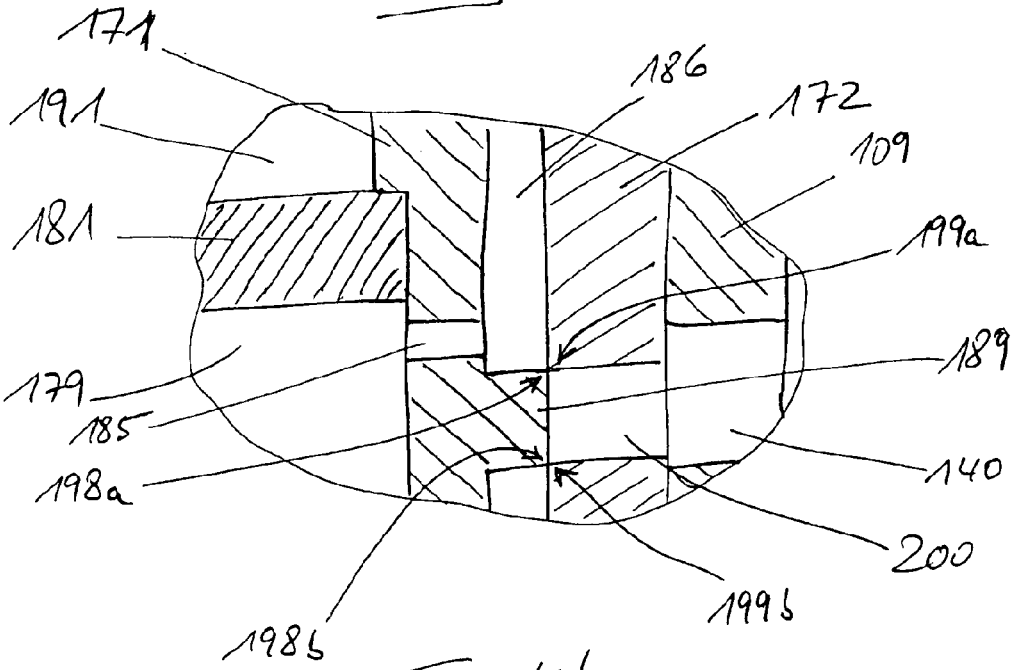
Figure 5:
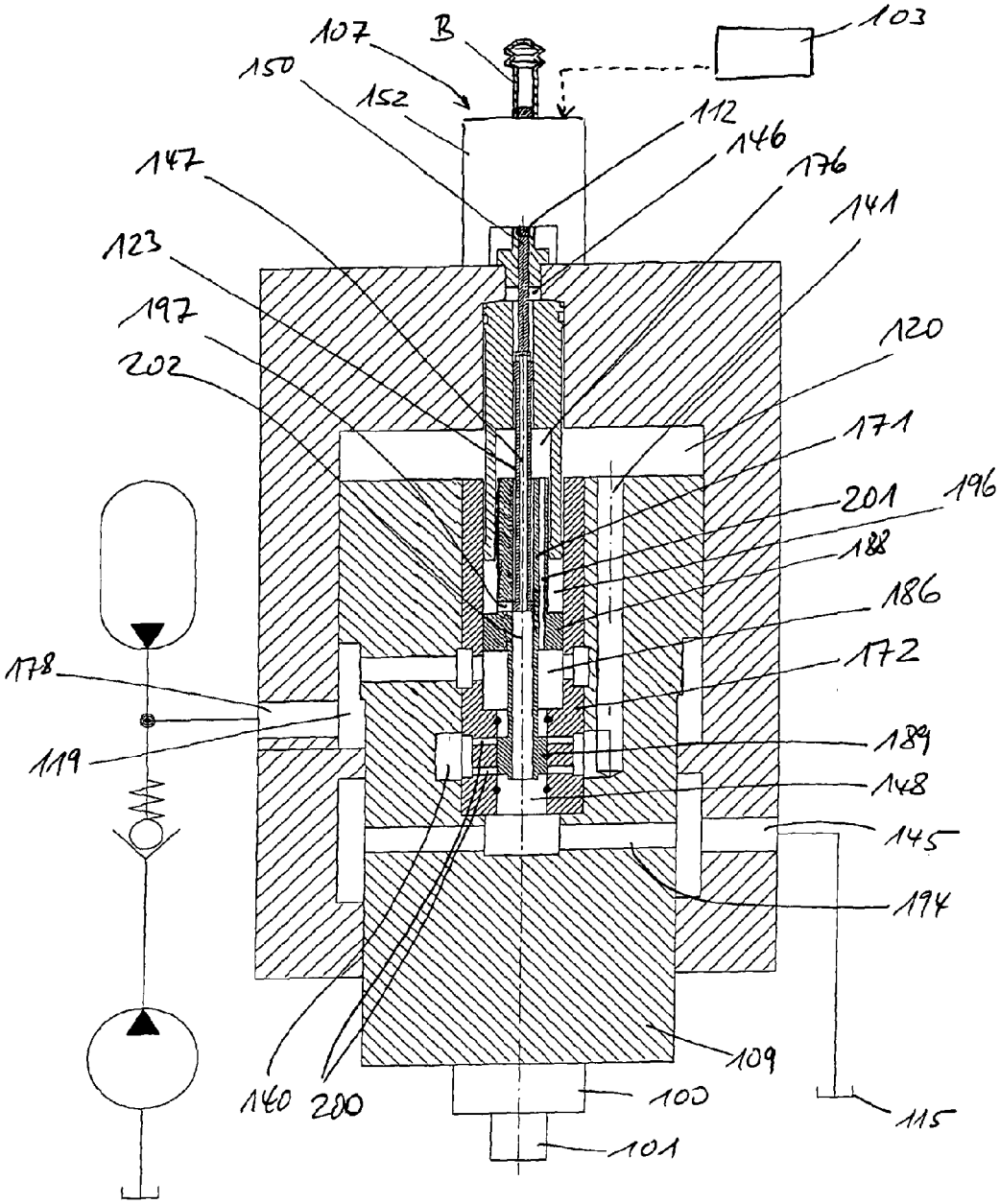

The present invention will be explained in more detail hereinafter on the basis of four exemplary embodiments illustrated in the drawing, wherein:

FIG. 1—shows a schematic section through an electrohydraulic booster constructed according to a first embodiment, FIG. 1*a*—shows an enlarged detail from FIG. 1, FIG. 2—shows the exemplary embodiment of an electrohydraulic booster as schematically illustrated in FIG. 1, with further structural details, FIG. 3—shows a section through an electrohydraulic booster constructed according to a second embodiment, FIG. 4—shows a section through an electrohydraulic booster constructed according to a third embodiment and provided with a two-stage hydromechanical power stage, FIG. 4*a*—and FIG. 4*b*—show enlarged details from FIG. 4, and FIG. 5—shows a section through an electrohydraulic booster constructed according to a fourth embodiment and provided with a two-stage hydromechanical power stage.

In order to move an element 1 (inserted in receptacle 0) forward and back along working axis 5 oriented in z-direction 4 in accordance with a movement program resident in numerical controller 3, there is provided an electrohydraulic booster 6, on which numerical controller 3 acts. As main components the electrohydraulic booster comprises an input stage in the form of an electromechanical transducer 2, which is constructed as an electrical linear direct drive 7, and a hydromechanical power stage 10, which is provided with a (two-part) cylinder 8 and a piston 9 guided displaceably therein along working axis 5. Electrical linear direct drive 7, whose motor axis 11 is oriented in z-direction, is activated directly by numerical controller 3 in such a way that its armature 12 occupies a well-defined position in z-direction, corresponding to the respective activation by numerical controller 3.

Hydromechanical power stage 10—connected between armature 12 of electrical linear direct drive 7 and element 1—is in communication with a pressurized-fluid supply 13, which in a manner known as such comprises a motor 14, a pump 16 driven thereby to suck in hydraulic fluid from tank 15, a check valve 17 and an accumulator 18. Between cylinder 8 and piston 9 of hydromechanical power stage 10 there are defined two working spaces, namely an annular first working space 19 and a second working space 20, which is also annular. This piston is constructed in the manner of a differential piston, wherein the total end face 21 of piston 9 measured in z-direction and bounding first working space 19 is smaller than the total end face 22 of piston 9—also measured in z-direction—bounding second working space 20.

The operating pressure of pressurized-fluid supply 13 is constantly present in first working space 19. In contrast, in order to achieve movement of piston 9 along the z-direction, as will be described in detail hereinafter, second working space 20 can be placed in controlled manner either in fluidic communication with pressurized-fluid supply 13, so that the operating pressure of the pressurized-fluid supply is present therein and piston 9 is moved downward together with element 1, or else in fluidic communication with tank 15, whereby the return-flow pressure is present therein and piston 9 is moved upward together with element 1. For this purpose there is provided a spool valve 23, which is disposed in the interior of piston 9 of hydromechanical power stage 10 and can be displaced along working axis 5, or in other words in z-direction. This spool valve 23 is guided in a guide bore, specifically with an upper collar 24 in an upper, first portion 25 of the guide bore and with a lower collar 26 in a lower, second portion 27 of the guide bore. This first portion 25 of the guide bore is constructed to be rigidly joined to the cylinder, in that it is formed by inner face 28 of a guide sleeve 29 inserted into cylinder 8. In contrast, second portion 27 of the guide bore is constructed to be rigidly joined to the piston, in that it is formed by lower inner face 30 of a stepped blind bore 31 disposed in piston 9. As a result, a two-part guide bore is provided in this way for spool valve 23. In contrast, outer face 32 of guide sleeve 29 bears sealingly in upper inner face 33 of stepped blind bore 31 of piston 9.

A high-pressure space 36 is defined by upper collar 24 and lower collar 26 of spool valve 23, by outer face 34 thereof disposed between the upper and lower collars, by the portions of inner face 28 of guide sleeve 29 disposed between the upper and lower collars and of upper inner face 33 and of lower inner face 30 of blind bore 31, and by end face 53 of guide sleeve 29 and shoulder 35 of blind bore 31. Via a plurality of radial bores 37, only one of which is illustrated for reasons of clarity, this space is constantly in communication with first working space 19, and so the operating pressure of pressurized-fluid supply 13 is constantly present therein. As regards the mode of operation explained hereinafter, the projection in z-direction of the face of high-pressure space 36 defined by shoulder 35 is substantially smaller than the projection in z-direction of end face 21 of piston 9 bounding first working space 19.

Two first leading edges 38, namely an upper first leading edge 38*a* and a lower first leading edge 38*b* are formed on lower collar 26 of the spool valve. These interact with second leading edges 39 corresponding to them, namely an upper second leading edge 39*a* and a lower second leading edge 39*b*, which are constructed on an annular groove 40 disposed in the piston in the region of lower inner face 30 of blind bore 31. Via a plurality of axial bores 41, only one of which is illustrated for reasons of clarity, annular groove 40 is constantly in communication with second working space 20.

Via a radial bore 43, a cavity 42 of hydromechanical power stage 10, bounded in particular by upper collar 24 of spool valve 23 and the region of inner face 28 of guide sleeve 29 disposed above upper collar 24 of the spool valve, is in communication with a return-flow port 45 for the hydraulic fluid, which port is disposed in the region of end wall 44 of cylinder 8 and is in communication with tank 15. Thus it represents an upper low-pressure space 46, in which substantially the return-flow pressure is present. Spool valve 23 is throughbored in longitudinal direction; the corresponding longitudinal bore 47, which is connected via openings 54 to upper low-pressure space 56, opens at the lower end of spool valve 23 into a lower low-pressure space 48, which is bounded in particular by lower collar 26 of spool valve 23, by the region of lower inner face 30 of blind bore 31 disposed under the lower collar of the spool valve, and by end face 49 of blind bore 31. Thus substantially the return-flow pressure is also present in lower low-pressure space 48.

Stator 52 of electrical linear direct drive 7 is rigidly connected to end wall 44 of cylinder 8 of hydromechanical power stage 10. Furthermore, electrical linear direct drive 7 is surrounded by a housing 49, which is joined sealingly to cylinder 8. Armature 12 of electrical linear direct drive 7 is connected rigidly to the spool valve via a coupling rod 50, which extends through end wall 44 of cylinder 8 and upper low-pressure space 46. Bore 51, which is provided in end wall 44 of cylinder 8 and through which coupling rod 50 emerges from the cylinder, is dimensioned such that exchange of hydraulic fluid is possible between upper low-pressure space 46 and the interior of housing 49.

If the electrical linear direct drive is activated by controller 3 in such a way that armature 12 is moved downward by an amount determined by the resident movement program, this movement is transmitted identically to spool valve 23 via coupling rod 50. Hereby an annular gap placing annular groove 40 in communication with high-pressure space 36 is formed between upper first leading edge 38*a* and upper second leading edge 39*a*. Accordingly, hydraulic fluid flows from the high-pressure space via annular groove 40 and axial bores 41 into second working space 20, whereby piston 8 is moved downward. The movement of piston 8 then corresponds identically to the amount by which spool valve 23 was displaced, since the downward movement of the piston ends when upper first leading edge 38*a* and upper second leading edge 39*a* are once again flush against one another, thus once again closing the annular gap described in the foregoing.

Conversely, if the electrical linear direct drive is activated by controller 3 in such a way that armature 12 is moved upward by an amount determined by the resident movement program, this movement is transmitted identically to spool valve 23 via coupling rod 50. Hereby an annular gap placing annular groove 40 in communication with lower low-pressure space 48 is formed between lower first leading edge 38*b* and lower second leading edge 39*b*. Accordingly, pressure equalization between second working space 20 and return-flow port 45 takes place via axial bores 41, annular groove 40, lower low-pressure space 48, longitudinal bore 47 of spool valve 23, upper low-pressure space 46 and radial bore 43, and so the return-flow pressure is present in second working space 20. Piston 8 is displaced upward by virtue of the operating pressure of pressurized-fluid supply 13 present in first working space 19. The movement of piston 8 then corresponds identically to the amount by which spool valve 23 was displaced upward, since the upward movement of the piston ends when lower first leading edge 38*b* and lower second leading edge 39*b* are once again flush against one another, thus once again closing the annular gap described in the foregoing. The hydraulic fluid forced out of second working space 20 during the corresponding upward movement of piston 8 flows through axial bores 41, annular groove 40, lower low-pressure space 48, longitudinal bore 47 of spool valve 23, upper low-pressure space 46 and radial bore 43 back into tank 15. At the same time, hydraulic fluid flows out of pressurized-fluid supply 13 back into first working space 19.

For the embodiment illustrated in FIG. 2, the explanations of FIG. 1 apply analogously. To avoid repetition, therefore, reference is made to the foregoing descriptions. Only three modifications are to be emphasized in this regard. Firstly, it is shown in FIG. 2 that guide sleeve 29 does not have continuous cylindrical shape over its outer face, but instead is provided with an upper collar 55, a lower collar 56 and a region 57 of reduced outside diameter between these; herewith there are achieved both manufacturing and operational benefits, resulting in particular from reduced requirements of manufacturing tolerance. Secondly, lower portion 27 of the guide bore is constructed not directly in piston 9, but instead in a piston sleeve 58 pressed rigidly into piston 9. Accordingly, second leading edges 39 in this embodiment are not formed by edges of annular groove 40; to the contrary, sleeve 58 is provided with radial openings 59, while upper second leading edges 39*a* and lower second leading edges 39*b* are formed by corresponding edges of openings 59. Once again, manufacturing benefits are associated herewith. Thirdly, the embodiment according to FIG. 2 is provided in the region of the passage of coupling rod 50 through end wall 44 of cylinder 8 with a separate insert E, which can be matched to the specific requirements pertaining to a possible seal and/or guide for coupling rod 50.

The embodiment according to FIG. 3 in turn corresponds substantially to the embodiment according to FIG. 2. To this extent, reference is made to the foregoing descriptions, in order to avoid repetition. Only one single noteworthy modification is to be emphasized in regard to FIG. 3. Specifically, in this case, return-flow port 60 is disposed not in the region of end wall 44 of cylinder 8 but instead in the region of the lower end of cylinder 8. Accordingly, in this case, lower low-pressure space 48 is in communication, via radial bores 61, which—in every position of piston 9 relative to cylinder 8—are in fluidic communication with an annular groove 62 disposed in the cylinder, with return-flow port 60, which opens into annular groove 62. In this embodiment, the return flow of hydraulic fluid developed during the upward movement of piston 9 does not pass through spool valve 23. To the contrary, longitudinal bore 63 extending through the spool valve has the sole purpose here of ensuring pressure equalization between lower low-pressure space 48 and upper low-pressure space 46. A (compensating) flow inside longitudinal bore 63 is developed only during the displacement of spool valve 23 in the guide bore, in a magnitude corresponding to this displacement.

Furthermore, the embodiment according to FIG. 3 also differs from that according to FIGS. 1 and 2 by the fact in particular that the electrical linear direct drive is not entirely housed in a housing, which is joined sealingly to the cylinder component of the hydromechanical power stage and whose interior space is in communication with a low-pressure space of the hydromechanical power stage containing a hydraulic fluid, but that instead (only) armature 12 of electrical linear direct drive 7 is received in a bushing B, which is joined sealingly to end wall 44 of the cylinder component of the hydromechanical power stage and extends through stator 52 of the electrical linear direct drive. A constant exchange of hydraulic fluid takes place between the interior space of bushing B and upper low-pressure space 46 of the hydromechanical booster stage. In the upper region of bushing B there is indicated a bellows-like compensating member, which can be deformed to correspond to the movement of armature 12, thus ensuring that the dynamic of the movement of the armature is not impaired by the hydraulic fluid present in the bushing.

As regards the embodiment illustrated in FIG. 4, it differs from the embodiment according to FIG. 3 by the fact in particular that a two-stage hydromechanical power stage 110 is provided in this case. To the extent that the components and function of this embodiment cannot be inferred directly from the explanations applicable analogously for the embodiments described in the foregoing, this embodiment can be described in detail as follows, parts having functions identical to those of FIGS. 1 to 3 being denoted by reference numerals that are higher by 100:

Hydromechanical power stage 110, interposed between armature 112 of electrical linear direct drive 107 and element 101 and connected to a pressurized-fluid supply 113, comprises a cylinder 108 and a piston 109 containing tool receptacle 100. Between cylinder 108 and piston 109 there are defined two working spaces, namely an annular first working space 119 and a second working space 120, which is also annular. The operating pressure of pressurized-fluid supply 113 is constantly present in first working space 119. In contrast, in order to achieve movement of piston 109 along the z-direction, as will be described in detail hereinafter, second working space 120 can be placed in controlled manner either in fluidic communication with pressurized-fluid supply 113, so that the operating pressure of the pressurized-fluid supply is present therein and piston 109 is moved downward together with element 101, or else in fluidic communication with tank 115, whereby the return-flow pressure is present therein and piston 109 is moved upward together with element 101. For this purpose there is provided a spool valve 123, which is constructed as a pilot spool valve and can be displaced along working axis 105, or in other words in z-direction. This spool valve 123 is guided in a guide bore, specifically with an upper collar 124 in an upper, first portion 125 of the guide bore and with a lower collar 126 in a lower, second portion 127 of the guide bore. First portion 125 of the guide bore is constructed to be rigidly joined to the cylinder, in that it is formed by inner face 128 of a guide sleeve 129 inserted into cylinder 108. In contrast, second portion 127 of the guide bore is constructed to be displaceable in z-direction, in that it is formed by upper inner face 170 of a control sleeve 171, which in turn is guided displaceably along the z-direction in a piston sleeve 172 pressed rigidly into piston 109. As a result, a two-part guide bore is provided in this way for spool valve 123.

In the region of the lower end of guide sleeve 129 there is formed a thickened lip 173, where on the one hand there is achieved extensive sealing of guide sleeve 129 relative to upper region 187*o* of the outer face of control sleeve 171 and on the other hand extensive sealing of guide sleeve 129 relative to inner face 175 of piston sleeve 172.

An inner upper high-pressure space 176 is defined by upper collar 124 and lower collar 126 of spool valve 123, by outer face 134 thereof disposed between the upper and lower collars, by the portions of inner face 128 of guide sleeve 129 disposed between the upper and lower collars and of upper inner face 170 of control sleeve 171. Via a bore 177, this space is constantly in communication with pressurized-fluid port 178, and so the operating pressure of pressurized-fluid supply 113 is constantly present therein. Furthermore, the operating pressure of pressurized-fluid supply 113 is constantly present in an inner lower high-pressure space 179, which is bounded by lower inner face 180 of control sleeve 171, by an upper plug 181, by lower inner face 182 of piston sleeve 172, by a lower plug 183 and by end face 184 of control sleeve 171. For this purpose, inner lower high-pressure space 179 is in communication with an annular outer high-pressure space 186 via radial bores 185 extending through control sleeve 171, which space is formed between inner face 175 of piston sleeve 172 and middle region 187*m* of the outer face of control sleeve 171 disposed between an upper collar 188 and a middle collar 189 of control sleeve 171, and—in every position of control sleeve 171 relative to piston sleeve 172—is in communication with first working space 119 via piston sleeve 172 and radial bores 190 extending through piston 109.

Above upper plug 181 and inside control sleeve 171 there is disposed an inner low-pressure space 191, which is in communication with upper low-pressure space 146 via longitudinal bore 147 extending through spool valve 123, which space in turn is in communication via a bore 192 with return-flow port 145. In this way substantially the return-flow pressure is present in inner low-pressure space 191.

The return-flow pressure is also present in annular lower low-pressure space 148, which is bounded by inner face 175 of piston sleeve 172, by middle collar 189 and by lower collar 193 of control sleeve 171 as well as by lower region 187*u* of the outer face of control sleeve 171 disposed between middle collar 189 and lower collar 193, and which is in communication with return-flow port 145 via radial bores 194 extending through piston sleeve 172 and piston 109 and via an annular groove 195.

Finally, there is provided a control space 196, which is bounded by inner face 175 of piston sleeve 172, by upper collar 188 of control sleeve 171, by upper region 187*o* of control sleeve 171 disposed above upper collar 188 and by thickened lip 173, and into which there open control openings 197 extending radially through control sleeve 171.

Two first leading edges 138, namely an upper first leading edge 138*a* and a lower first leading edge 138*b* are formed on lower collar 126 of spool valve 123. These interact with second leading edges 139 corresponding to them, namely upper second leading edge 139*a* and lower second leading edge 139*b*, which are constructed on inner control openings 197 of control sleeve 171.

Third leading edges 198, namely an upper third leading edge 198*a* and a lower third leading edge 198*b* are constructed on middle collar 189 of the control sleeve. These interact with fourth leading edges 199 corresponding to them, namely upper fourth leading edges 199*a* and lower fourth leading edges 199*b*, which are formed on outer control openings 200, which extend through piston sleeve 172 and communicate with an annular groove 140, which is disposed in piston 109 and in turn is in communication with second working space 120 via a plurality of axial bores, only one of which is illustrated for clarity.

If electrical linear direct drive 107 is activated by controller 103 in such a way that armature 112 is moved downward by an amount determined by the resident movement program, this movement is transmitted identically to spool valve 123 via coupling rod 150. Hereby apertures placing control space 196 in communication with upper high-pressure space 176 are formed between upper first leading edge 138*a* and upper second leading edges 139*a*. Accordingly, hydraulic fluid flows from upper high-pressure space 176 through inner control openings 197 into control space 196, in this way causing a downward movement of control sleeve 171. In regard to this function, it is to be kept in mind that, in the sense of the hydraulic forces acting on the control sleeve, the projection in z-direction of end face 184 of control sleeve 171 bounding lower high-pressure space 179 and of upper plug 181 acts counter to the projection in z-direction of the end face of control sleeve 171, bounding upper high-pressure space 176, as well as of the annular face of upper collar 188, bounding the control space. It is therefore essential for this function that the sum of the latter faces is greater than the sum of the former faces, since otherwise control sleeve 171 would not follow a downward movement of spool valve 123. This is achieved by the fact that lower collar 193 of control sleeve 171 has a smaller diameter than do middle and upper collars 189 and 188 respectively, and so the bore of piston sleeve 172 has a shoulder in the region of lower low-pressure space 148.

The movement that control sleeve 171 executes on the whole then corresponds identically to the amount by which spool valve 123 was displaced, since the downward movement of the control sleeve ends when upper first leading edge 138*a* and upper second leading edge 139*a* are once again flush against one another, thus once again closing the apertures described in the foregoing. Because of the downward displacement of the control sleeve, the apertures placing annular outer high-pressure space 186 in communication with annular groove 140 via outer control openings 200 are opened between upper third leading edge 198*a* and upper fourth leading edges 199*a*. Accordingly, hydraulic fluid flows from annular outer high-pressure space 186 through outer control openings 200 via annular groove 140 and axial bores 141 into second working space 120, whereby piston 108 is moved downward. The movement of piston 108 then corresponds identically to the amount by which spool valve 123 and accordingly control sleeve 171 was displaced, since the downward movement of the piston ends when upper third leading edge 198*a* and upper fourth leading edge 199*a* are once again flush against one another, thus once again closing the apertures described in the foregoing.

Conversely, if electrical linear direct drive 107 is activated by controller 103 in such a way that armature 112 is moved upward by an amount determined by the resident movement program, this movement is transmitted identically to spool valve 123 via coupling rod 150. Hereby apertures placing control space 196 in communication with inner low-pressure space 191 are formed between lower first leading edge 138*b* and lower second leading edges 139*b*. Accordingly, pressure equalization between control space 196 and return-flow port 145 takes place via inner control openings 197, longitudinal bore 147 of spool valve 123, upper low-pressure space 146 and bore 192, and so the return-flow pressure is present in control space 196. Control sleeve 171 is displaced upward by virtue of the operating pressure of pressurized-fluid supply 113 present in inner lower high-pressure space 179. For this upward movement of control sleeve 171 (with unpressurized control space 196), it is sufficient that the projection in z-direction of end face 184 of control sleeve 171 bounding lower high-pressure space 179 and of upper plug 181 is larger than the projection in z-direction of the end face of control sleeve 171 bounding upper high-pressure space 176. The movement of control sleeve 171 then corresponds identically to the amount by which spool valve 123 was displaced upward, since the upward movement of control sleeve 171 ends when lower first leading edge 138*b* and lower second leading edge 139*b* are once again flush against one another, thus once again closing the apertures described in the foregoing. The hydraulic fluid forced out of control space 196 during the corresponding upward movement of control sleeve 171 flows through inner control openings 197, longitudinal bore 147 of spool valve 123, upper low-pressure space 146 and bore 192 back into tank 115. At the same time, hydraulic fluid flows out of pressurized-fluid supply 113 back into inner lower high-pressure space 179. Because of the upward displacement of control sleeve 171, the apertures placing annular lower low-pressure space 148 in communication with annular groove 140 via outer control openings 200 are opened between lower third leading edge 198*b* and lower fourth leading edges 199*b*. Accordingly, pressure equalization between second working space 120 and return-flow port 145 takes place via axial bores 141, and so the return-flow pressure is present in second working space 120. Piston 108 is additionally displaced upward by virtue of the operating pressure of pressurized-fluid supply 113 present in first working space 119. The movement of piston 108 then corresponds identically to the amount by which spool valve 123 and accordingly control sleeve 171 was displaced upward, since the upward movement of piston 108 ends when lower third leading edge 198*b* and lower fourth leading edges 199*b* are once again flush against one another, thus once again closing the apertures described in the foregoing. The hydraulic fluid forced out of second working space 120 during the corresponding upward movement of piston 108 flows through axial bores 141, annular groove 140, lower low-pressure space 148 and radial bores 194 back into tank 115. At the same time, hydraulic fluid flows out of pressurized-fluid supply 113 back into first working space 119.

Two stops, which limit the upward and downward movement of control sleeve 171 relative to piston sleeve 172, must also be mentioned. For this purpose there is provided on the one hand a ring, which limits the upward movement of the control sleeve, is fixed in the region of control space 196 to inner face 175 of piston sleeve 172 bounding this space and forms a stop for upper collar 188 of the control sleeve. On the other hand, the downward movement of control sleeve 171 relative to piston sleeve 172 is limited by the fact that end face 184 of control sleeve 171 is stopped against lower plug 183. Because of these stops, however, if the complete movement of control sleeve 171 is to take place corresponding to the upward or downward stroke of spool valve 123 as described in the foregoing, it is a prerequisite, under certain circumstances, namely when the current positioning stroke of the spool valve is greater than the movement capability of the control sleeve relative to the piston sleeve as defined by the stop in question, is that piston 109 together with piston sleeve 172 has already followed the movement of the control sleeve partly upward or downward. If control sleeve 171 is at the stop limiting its movement upward or downward relative to piston sleeve 172 (as a result of a correspondingly large current positioning stroke of spool valve 123), control sleeve 171 and piston 109 jointly execute part of the upwardly or downwardly directed movement.

As regards the leading edges that cooperate with one another, or in other words the two first and second pairs of leading edges as well as the two third and fourth pairs of leading edges, the exemplary embodiment illustrated in FIG. 5 functions in principle in a manner comparable to that of the exemplary embodiment of FIG. 4; to the extent necessary, further details will become apparent from the explanations provided hereinafter. First of all, as regards the engineering and structural configuration, illustrated in FIG. 5, of the electrohydraulic drive unit of an inventive stamping machine and of its differences compared with the embodiment according to FIG. 4, entirely relevant viewpoints described in detail hereinafter will be emphasized:

In the first place, the operating pressure of pressurized-fluid supply 113 is admitted from annular outer high-pressure space 186 to inner upper high-pressure space 176 via a plurality of axial bores 201 extending through control sleeve 171. Hereby it is possible to dispense with bore 177, which is provided according to FIG. 4 and extends through cylinder component 108.

Furthermore, control sleeve 171 is significantly shortened compared with the embodiment according to FIG. 4, by the fact that the lower portion of the control sleeve is omitted. In the terminology of the foregoing explanation of FIG. 4, control sleeve 171 according to FIG. 5 is provided with only two collars, namely upper collar 188 and middle collar 189 (which is provided with the two third leading edges). The portion of the control sleeve disposed under middle collar 189 in the embodiment according to FIG. 4 has therefore been omitted from the embodiment according to FIG. 5. Also omitted is lower inner high-pressure space 179 of the embodiment according to FIG. 4. Firstly this permits a particularly low overall height of the hydromechanical power stage and thus a particularly compact construction of the electrohydraulic booster, and so—by virtue of the reduction of moving masses—it is also favorable for the dynamic attainable therewith. Secondly, this design makes it possible to place upper low-pressure space 146 in communication with lower low-pressure space 148 via control sleeve 171, longitudinal bore 202 extending through its entire length and longitudinal bore 147 of spool valve 123. In this way bores 192 provided in the embodiment according to FIG. 4 can also be omitted. On the whole, significant structural simplifications and the possibility of a particularly compact design are obviously achieved hereby compared with the embodiment according to FIG. 4, without impairing the mode of operation.

Although the parallels that exist from the foregoing explanations of FIG. 4 would in principle enable the person skilled in the art to derive the mode of operation of the embodiment according FIG. 5, the latter will be specially explained as follows:

If electrical linear direct drive 107 is activated by controller 103 in such a way that armature 112 is moved downward by an amount determined by the resident movement program, this movement is transmitted identically to spool valve 123 via coupling rod 150. Hereby apertures placing control space 196 in communication with upper high-pressure space 176 are formed between the upper first leading edge of spool valve 123 and the upper second leading edges of control sleeve 171. Accordingly, hydraulic fluid flows from upper high-pressure space 176 through inner control openings 197 into control space 196, in this way causing a downward movement of control sleeve 171. In regard to this function, it is to be kept in mind that, in the sense of the hydraulic forces acting on control sleeve 171, the projection in z-direction of the annular face—reduced by the annular face of middle collar 189 bounding annular outer high-pressure space 186—of upper collar 188 bounding annular upper high-pressure space 186 acts counter to the projection in z-direction of the end face of control sleeve 171 bounding upper high-pressure space 176 as well as of the annular face of upper collar 188 of the control sleeve 171 bounding the control space. It is therefore essential for the function that the sum of the latter areas is greater than the sum of the former areas, since otherwise control sleeve 171 would not follow a downward movement of spool valve 123.

Because of the downward displacement of the control sleeve, the apertures placing annular outer high-pressure space 186 in communication with annular groove 140 via outer control openings 200 are opened between the upper third leading edge provided on middle collar 189 of control sleeve 171 and the upper fourth leading edges provided on piston sleeve 172. Accordingly, hydraulic fluid flows from annular outer high-pressure space 186 through outer control openings 200 via annular groove 140 and axial bores 141 into second working space 120, whereby piston 108 is moved downward. The movement of piston 108 then corresponds identically to the amount by which spool valve 123 and accordingly control sleeve 171 was displaced, since the downward movement of the piston ends when the upper third leading edge and the upper fourth leading edges are once again flush against one another, thus once again closing the apertures described in the foregoing.

Conversely, if electrical linear direct drive 107 is activated by controller 103 in such a way that armature 112 is moved upward by an amount determined by the resident movement program, this movement is transmitted identically to spool valve 123 via coupling rod 150. Hereby apertures placing control space 196 in communication with lower low-pressure space 148 via longitudinal bore 202 of control sleeve 171 are formed between the lower first leading edge provided on spool valve 123 and the lower second leading edges provided on control sleeve 171. Accordingly, pressure equalization between control space 196 and return-flow port 145 takes place via inner control openings 197 and longitudinal bore 202 of control sleeve 171, and so the return-flow pressure is present in control space 196. Control sleeve 171 is additionally displaced upward by virtue of the operating pressure of pressurized-fluid supply 113 present in annular outer high-pressure space 186. For this upward movement of control sleeve 171 (with unpressurized control space 196), it is sufficient that the projection in z-direction of the annular face—reduced by the annular face of middle collar 189 bounding annular outer high-pressure space 186—of upper collar 188 of control sleeve 171 bounding annular upper high-pressure space 186 is larger than the projection in z-direction of the end face of control sleeve 171 bounding upper high-pressure space 176. This is achieved by the shoulder provided in piston sleeve 172 in the region of annular outer high-pressure space 186, by virtue of which the diameter of upper collar 188 of the control sleeve is distinctly larger than the diameter of middle collar 189 of the control sleeve.

The hydraulic fluid forced out of control space 196 during the corresponding upward movement of control sleeve 171 flows through longitudinal bore 202 of control sleeve 171 and lower low-pressure space 148 back into tank 115. At the same time, hydraulic fluid flows out of pressurized-fluid supply 113 back into annular outer high-pressure space 186. Because of the upward displacement of control sleeve 171, apertures placing lower low-pressure space 148 in communication with annular groove 140 via outer control openings 200 are opened between the lower third leading edge and the lower fourth leading edges.

Accordingly, pressure equalization between second working space 120 and return-flow port 145 takes place via axial bores 141, and so the return-flow pressure is present in second working space 120. Piston 108 is additionally displaced upward by virtue of the operating pressure of pressurized-fluid supply 113 present in first working space 119. The hydraulic fluid forced out of second working space 120 during the corresponding upward movement of piston 108 flows through axial bores 141, annular groove 140, lower low-pressure space 148 and radial bores 194 back into tank 115. At the same time, hydraulic fluid flows out of pressurized-fluid supply 113 back into first working space 119.

Also illustrated in FIG. 5 are two stops, which limit the movement of control sleeve 171 relative to piston sleeve 172 in both directions, specifically to approximately 2% to 3% of the total maximum working stroke of piston 109 in each direction, thus corresponding, for a designed working stroke of 40 mm, to a movement capability of control sleeve 171 relative to piston 109 of 2 mm to 3 mm respectively from the neutral position shown for the spool valve in the drawing. These stops are the two rings fixed in the lower portion of the bore of the piston sleeve, against which rings middle collar 189 of control sleeve 171 can be stopped. The explanations of FIG. 4 are valid by analogy as regards the function of these stops. Obviously the person skilled in the art is also capable of finding a different configuration or arrangement of stops suitable for safeguarding the third leading edges disposed on middle collar 189.

I claim:

1. An electrohydraulic booster comprising an electromechanical transducer (2; 102) and a hydromechanical power stage (10; 110), which is connected to a pressurized-fluid supply (13; 113) and is provided with a cylinder (8; 108) and a piston (9; 109) that can be displaced therein along a working axis (5; 105), wherein the electromechanical transducer acts on a spool valve (23; 123), which is associated with the hydromechanical power stage, is disposed at least partly in the interior of the piston (9; 109) and is guided displaceably along the working axis in a guide bore, and which is provided with two first leading edges (38*a*, 38*b*; 138*a*, 138*b*) that cooperate with corresponding second leading edges (39*a*, 39*b*; 139*a*, 139*b*) provided on the guide bore to form a hydraulic sequential control, wherein the guide bore is constructed in two parts, with a first portion (25; 125) joined rigidly to the cylinder and a second portion (27; 127) whose position can be varied along the working axis (5; 105) and which is provided with the second leading edges (39*a*, 39*b*; 139*a*, 139*b*), wherein the first portion (25; 125) of the guide bore is constructed in a guide sleeve (29; 129) inserted in the cylinder (8; 108).

2. An electrohydraulic booster according to claim 1, wherein the guide sleeve (29: 129) is surrounded by flowing hydraulic fluid in at least regions of its outer surface, and preferably is surrounded by an annular hydraulic working space (20; 120).

3. An electrohydraulic booster according to claim 1, wherein the hydromechanical power stage (10) is of one-stage construction, wherein the second portion (27) of the guide bore is joined rigidly to the piston.

4. An electrohydraulic booster according to claim 1, wherein an outer face (32) of the guide sleeve (29) bears sealingly on an inner face (33) of a blind bore (31) of the piston (9).

5. An electrohydraulic booster according to claim 1, wherein the hydromechanical power stage (110) is of two-stage construction, wherein the spool valve (123) represents a pilot spool valve, and the second portion (127) of the guide bore as well as the second leading edges (139*a*, 139*b*) are constructed on a control sleeve (171) guided displaceably along the working axis (105) in the piston (109), the control sleeve in turn being provided with two third leading edges (198*a*, 198*b*), which cooperate with two corresponding fourth leading edges (199*a*, 199*b*) of the piston (109) to form a hydraulic sequential control.

6. An electrohydraulic booster according to claim 5, wherein an outer face of the guide sleeve (129) bears sealingly on an inner face (175) of the piston (109) or on a piston sleeve (172) inserted therein.

7. An electrohydraulic booster according to claim 5, further comprising stops, which limit the movement of the control sleeve (171) relative to the piston (109) in both directions.

8. An electrohydraulic booster according to claim 1, wherein the electromechanical transducer (2; 102) is constructed as an electrical linear direct drive (7; 107) with an armature (12; 112) that can be moved along the working axis (5; 105) of the hydromechanical power stage (10; 110).

9. An electrohydraulic booster according to claim 8, wherein a stator (52; 152) of the electrical linear direct drive (7; 107) is joined rigidly to an end wall (44; 144) of the cylinder of the hydromechanical power stage (10; 110).

10. An electrohydraulic booster according to claim 9, wherein the armature (12; 112) of the electrical linear direct drive (7; 107) is joined rigidly to the spool valve (23; 123) via a coupling rod (50; 150) passing through the end wall (44; 144) of the cylinder (8; 108).

11. An electrohydraulic booster according to claim 10, wherein the coupling rod (50; 150) extends through a cavity (42; 142) of the cylinder (8; 108) of the hydromechanical power stage (10; 110), in which cavity the pressure is substantially the return-flow pressure.

12. An electrohydraulic booster according to claim 1, wherein an armature (12; 112) of an electrical linear direct drive (7; 107) is received in a bushing (B) joined sealingly to the cylinder (8; 108) of the hydromechanical power stage (10; 110) and passing through a stator (52; 152) of the electrical linear direct drive, the interior space of the bushing being in communication with a low-pressure space (46; 146), containing hydraulic fluid, of the hydromechanical power stage.

13. An electrohydraulic booster according to claim 8, wherein the electrical linear direct drive (7; 107) is provided with a housing (49; 149) joined sealingly to the cylinder (8; 108) of the hydromechanical power stage (10; 110), the interior space of the housing being in communication with a space (42; 142), containing hydraulic fluid, of the hydromechanical power stage (10; 110).

14. An electrohydraulic booster according to claim 1, wherein a return-flow port (45) of the hydromechanical power stage (10) is disposed in the region of an end wall (44) of the cylinder (8), and so the return flow passes through the spool valve (23) of the hydromechanical power stage (10).

* * * * *

UNITED STATES PATENT AND TRADEMARK OFFICE

CERTIFICATE OF CORRECTION

PATENT NO. : 8,074,557 B2
APPLICATION NO. : 12/779188
DATED : December 13, 2011
INVENTOR(S) : Manfred Kurz It is certified that error appears in the above-identified patent and that said Letters Patent is hereby corrected as shown below:

On the title page, insert item (30)

--(30) Foreign Application Priority Data

Nov. 15, 2007 (DE)..... 10 2007 054 533.0
Nov. 16, 2007 (DE)..... 10 2007 054 774.0--

Signed and Sealed this
Seventh Day of February, 2012

David J. Kappos

David J. Kappos
*Director of the United States Patent and Trademark Office*